US007775023B2

(12) United States Patent
Völlmecke et al.

(10) Patent No.: US 7,775,023 B2
(45) Date of Patent: Aug. 17, 2010

(54) SNAFFLE BIT WITH TWO SIDE MEMBERS AND A SHACKLE AND METHOD OF MANUFACTURING SAME

(75) Inventors: Valentin Völlmecke, Iserlohn (DE); Heinz Baumann, Iserlohn (DE)

(73) Assignee: Herm. Sprenger GmbH & Co. KG, Iserlohn (DE)

( * ) Notice: Subject to any disclaimer, the term of this patent is extended or adjusted under 35 U.S.C. 154(b) by 817 days.

(21) Appl. No.: 11/659,026

(22) PCT Filed: Feb. 12, 2005

(86) PCT No.: PCT/DE2005/000247

§ 371 (c)(1),
(2), (4) Date: Jan. 30, 2007

(87) PCT Pub. No.: WO2006/012814

PCT Pub. Date: Feb. 9, 2006

(65) Prior Publication Data

US 2009/0223182 A1 Sep. 10, 2009

(30) Foreign Application Priority Data

Jul. 30, 2004 (DE) ..... 10 2004 037 469
Jan. 15, 2005 (DE) ..... 10 2005 001 968

(51) Int. Cl.
*B68B 1/06* (2006.01)

(52) U.S. Cl. ..... 54/8

(58) Field of Classification Search ..... 54/7, 54/8, 9

See application file for complete search history.

(56) References Cited

U.S. PATENT DOCUMENTS 157,340 A 12/1874 Mellor
805,606 A * 11/1905 Werk ..... 54/8
1,956,861 A * 5/1934 Freysinger ..... 54/8
3,623,294 A 11/1971 Stone et al.

(Continued)

FOREIGN PATENT DOCUMENTS

DE 194071 3/1907

(Continued)

OTHER PUBLICATIONS

International Search Report for International Application No. PCT/DE2005/000247.

*Primary Examiner*—Rob Swiatek
(74) *Attorney, Agent, or Firm*—McCarter & English, LLP

(57) ABSTRACT

The invention relates to a horse snaffle bit with two lateral parts and a shackle, which is situated between these parts and comprises at least one joint and two lateral sections, each lateral section having an end located a distance from the joint and a borehole is made in these distal ends of the lateral sections to accommodate one of the parts in a manner that enables them to move freely. Additionally, each lateral section has a first surface area and a second surface area; the first surface area has a matte surface and extends from the joint to a distance of at least 20% and no greater than 50% of the overall length of the lateral section from the joint, and the second surface area has a high-lustrous surface and is connected to the first surface area and extends to the distal end of the lateral section.

20 Claims, 1 Drawing Sheet

U.S. PATENT DOCUMENTS

| | | | |
|---|---|---|---|
| 4,005,564 | A | 2/1977 | Simington |
| 6,324,821 | B1 | 12/2001 | Bauer et al. |

FOREIGN PATENT DOCUMENTS

| | | |
|---|---|---|
| DE | 43 26 550 | 11/1994 |
| EP | 0017959 | 4/1980 |
| GB | 651913 | 4/1951 |
| WO | WO 00/35804 | 6/2000 |

* cited by examiner

Fig. 1
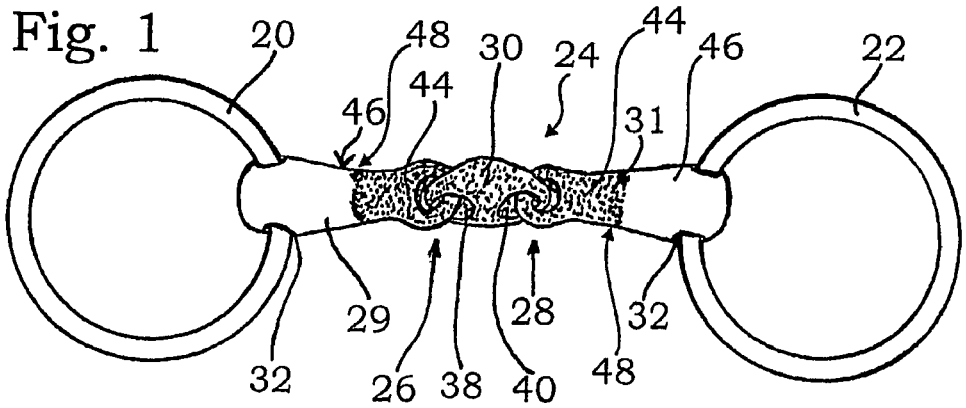
Fig. 2
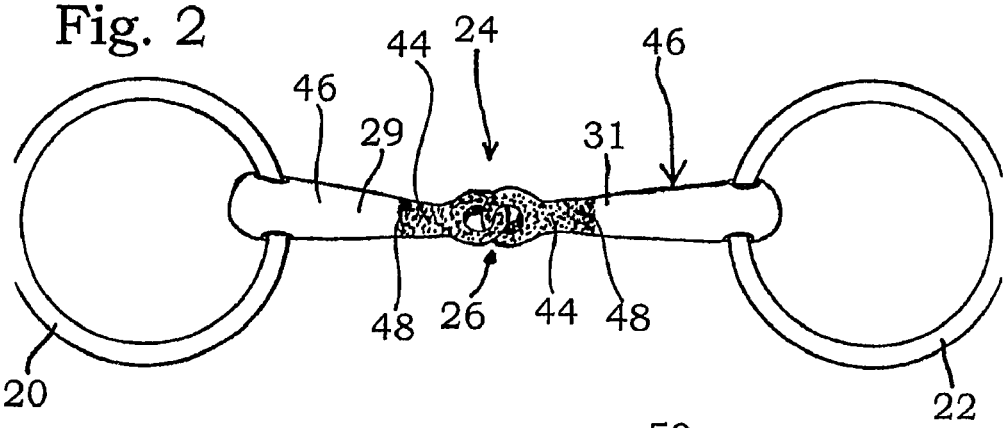
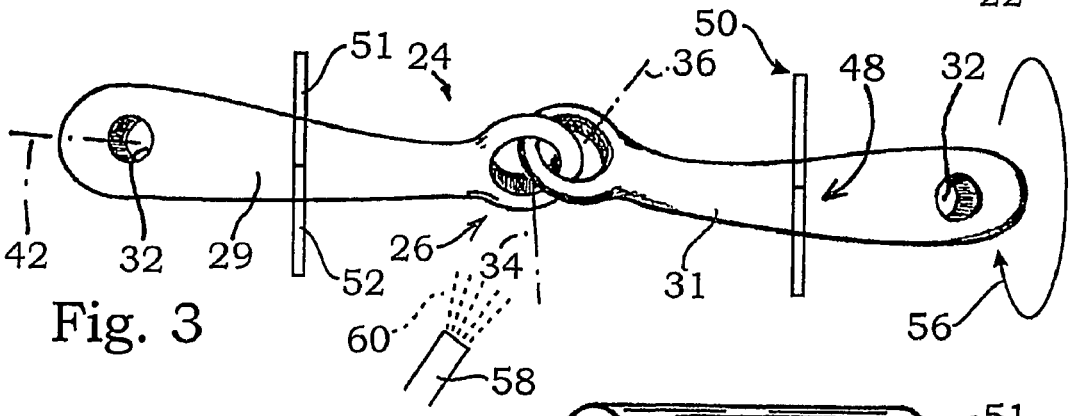
Fig. 3
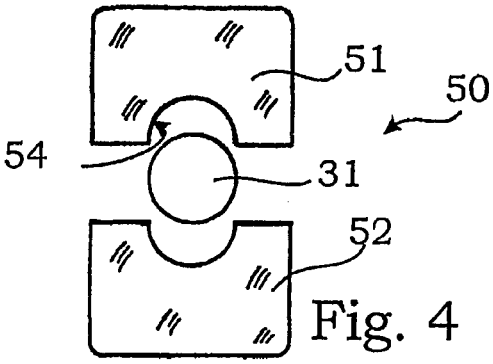
Fig. 4
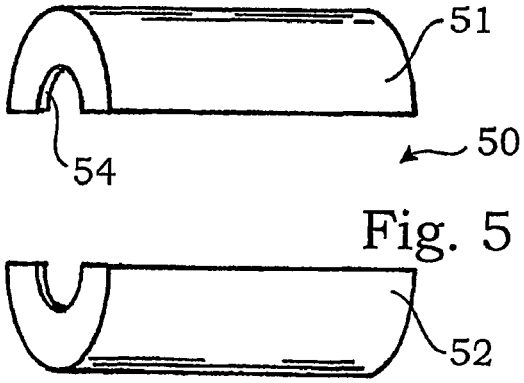
Fig. 5

SNAFFLE BIT WITH TWO SIDE MEMBERS AND A SHACKLE AND METHOD OF MANUFACTURING SAME

CROSS-REFERENCE TO RELATED APPLICATIONS

This application is the U.S. National Stage of International Application No. PCT/DE2005/000247, filed Feb. 12, 2005, which claims priority to German Application No. DE 10 2004 037 469.4, filed Jul. 30, 2004 and German Application No. DE 10 2005 001 968.4, filed Jan. 15, 2005, the contents of which are expressly incorporated by reference in their entirety as part of the present disclosure.

BACKGROUND

The invention relates to a snaffle bit for a horse with two side members and one shackle interposed between said members, said shackle having at least one joint on one side and being provided on the other with two side portions, a bore being provided in the end of each of the side portions that is remote from the at least one joint, said bore receiving a respective one of the side members so as to allow them to move freely and to a method of manufacturing such a snaffle bit.

A such type snaffle bit for a horse is known from the European Patent 17 959 or the WO 00/35804. In principle, this snaffle bit proved to be very efficient. Reference is also made to the snaffle bits cited in this European Patent 17 959, more specifically to those according to U.S. Pat. No. 4,005,564; GB-A-7712/1914; GB-A-65/1913 and DE-C-194 071.

In devising the snaffle bit previously proposed and mentioned herein above, it proved particularly efficient to design the shackle so as to be even, smooth in contour and without edges and to have the transitions between discrete portions of the shackle made soft. It also proved very advantageous to have the cross section of the side portions tapering from the rings inward and this advantage will be retained. The same applies for the curved design of the shackle according to which a center line of the shackle connecting the bores for receiving the two rings so as to provide them with freedom of movement is curved toward the front, toward the roof of the mouth. With the bit of the type mentioned herein above, this feature is achieved in providing the shackle with a joint so that this curved implementation can be achieved.

Bits which have a jointed shackle will be designated herein after as "single joint" snaffle bits, and bits which have a shackle with two joints as "double joint" snaffle bits. These two embodiments of the snaffle bit for horses of the type mentioned herein above have come to be highly appreciated by horsemen.

The present invention would like to retain the major features of the snaffle bit of the type mentioned herein above and to improve it so as to make it even better suited and advantageous for a horse and more specifically so that it is better accepted by a horse.

This is where the invention comes to effect. It aims at developing the snaffle bit of the type mentioned herein above and the method of manufacturing same in such a manner that it is preferably accepted by a horse.

SUMMARY

In view of the snaffle bit of the type mentioned herein above, this object is achieved in that each side portion comprises a first surface area and a second surface area, that said first surface area extends, commencing at the joint, as far as at least 20% and not exceeding 50% of the overall length of the side portion of the joint, that said second surface area adjoins said first surface area and extends as far as the remote end of said side portion, that said first surface area has a mat surface and that said second surface area has a high gloss surface. As to the method, the object is achieved by a method having the features of claim 12 or 13.

Whilst in the prior art snaffle bit the surface of the side portions is continuous and uniform, in the snaffle bit of the invention this surface is divided into two areas. Tests showed that this bit is much better accepted by a horse. The tongue of a horse feels the difference between the two surface areas and experiences them. The tongue of a horse is so sensitive that its sense of touch immediately notices the change in the surface. The sense of touch of the horse's tongue works similar to that of a human tongue. The sense of touch exacerbates the differences it feels. This detected difference incites the horse to play. Chewing activity is increased. The horse relaxes and is willing to work. Increased chewing activity increases the flow of saliva. It is particularly suited for horses with dry mouths.

There is an optical difference between the two surface areas. This difference gives the bit an aesthetically particularly pleasing appearance.

The effective surface is increased by processing it with blast material, this processing also being referred to as sandblasting. This allows for increasing the effective surface. Commencing at the joint, the first surface area may also reach as far as 80% maximum of the overall length of the side portion of the joint.

In a preferred implementation, the snaffle bit of the invention has one or two joints. Although three or even more joints may also be provided, the embodiments of preference have one or two joints.

Moreover, it proved very advantageous to manufacture the bit according to the invention in the same way as the previously proposed bit mentioned herein above from an alloy as it has been described in the German Patent DE 43 26 550 C1 that contains a high amount of copper and still has a high mechanical strength. Further materials that may be considered are stainless steel and aluminium bronze.

In principle, the design of the joints is discretionary. It is possible to have recourse to the embodiments as they have been described in the European Patent mentioned herein above and in the remaining state of the art. Simple designs of the joints however proved particularly efficient, namely such in which the joints are substantially defined by the interlock of two rings. As a joint, such joints have greater freedom of movement than joints that are defined by a rigid axis of articulation and that allow the two portions joined by the axis of the joint to merely move in one plane relative to one another. In that the joints are designed as rings, soft transitions are additionally achieved. This allows ease of manufacture. Maintenance and cleaning are easy since the discrete hollow spaces are readily accessible. This also makes it possible to even sandblast the joint region. Furthermore, additional materials for making the joint move in a smooth way are not required. Eventually, this design of the joints excludes the risk of jamming the tongue of the horse and so on.

In a preferred embodiment, the central portion of a bit with two joints has two paralleled bores for forming the two joints of the shackle. It is however also absolutely possible to provide the central portion with two bores that are positioned at right angles to one another.

It proved particularly advantageous to make the central portion of a bit with two joints the shortest possible. Central portions with a maximum length of 4 cm, more specifically of 3 cm, proved appropriate. In bits with only one single joint, a short central region resembling a central portion is realized in that the unique joint provided there is thicker than the adjacent regions so that the shortness of less than 4, resp. 3, 2 or of less than 1 cm needed and required above is achieved.

It eventually proved advantageous to thicken the central portion as compared to the adjacent side portions. Like in prior art, the side portions taper from the rings inward. In the central region, increased thickness is again achieved. Accordingly, the smallest thickness is found between the central region and the rings. This shape is possible and wanted for the snaffle bit with one joint as well as for the snaffle bit with two joints.

BRIEF DESCRIPTION OF THE DRAWINGS

Other features and advantages will become more apparent upon reviewing the appended claims and the following non restrictive description of embodiments of the invention, given by way of example only with reference to the drawing. In said drawing:

FIG. 1: is a rear view showing a snaffle bit for a horse with two joints,

FIG. 2: is a view according to FIG. 1 showing a snaffle bit for a horse with one single joint, FIG. 3: is a 90 degree rotated view from that shown in FIG. 2 illustrating the shackle only, that is, without the rings; the representation corresponds to a view from the bottom onto the corresponding parts of FIG. 2 and with two cover members, FIG. 4: is a top view of the cover members of FIG. 3 in a separated condition and with an interposed side portion, and FIG. 5: is a perspective illustration of another embodiment of a cover member.

DETAILED DESCRIPTION

As can be seen from the FIGS. 1 and 2, the snaffle bit for a horse has two side members 20, 22 that are configured to be rings and one shackle 24 interposed between said two side members 20, 22. In the exemplary embodiment according to FIG. 1 it has two joints, in the exemplary embodiment according to the FIGS. 2 through 4 it has one single joint. Accordingly, the exemplary embodiment according to FIG. 1 has two joints 26, 28 that are located at either end of a central portion 30 whereas the shackle of the second exemplary embodiment only has one single joint 26.

The shackle 24 has two side portions 29, 31. In the side portions, bores 32 are provided for each receiving a respective one of the side members 20 and 22 so as to allow said rings to move freely. These two bores 32 at the remote end, meaning at the free end regions of the shackle 24, define a plane that coincides with the plane of the sheet in the representation according to the FIGS. 1 and 2. In the illustration according to FIG. 3, this plane is normal to the plane of the paper. Side portions 29, 31 each also have a central end in the center of the shackle 24.

In the exemplary embodiments illustrated, the joints 26, 28 are each designed as eyes that interlock with play, said eyes being provided at the inner end regions of the side portions 29, 31 or, on the bit that has two joints, at the central portion 30. This specific design of the joints 26, 28 provides the thus connected members with a limited three-dimensional range of movement. The articulation axis is indicated in FIG. 3 by a dot-dash line at 34. The specific design of the joint that consists of two interlocking eyes provides a second articulation axis 36 that is arranged at right angles thereto. It is indicated in FIG. 3 by a dot-dash line 36. Both axes are inclined at an angle of 45° to the plane of the bores 32 and accordingly to the plane of the paper in FIG. 3. The bores 32 have a bore axis 42.

It is preferred that the side portions 29, 31 be built identically. Their surface is divided into a first surface area 44 and a second surface area 46. Commencing at the central end of the side portion 29, 31 where the joints 26, 28 are formed, the first surface area extends outward over a distance of up to at least 20% of the overall length of the side portion. In the implementation shown in FIG. 1, the length of the first surface region extends approximately over half of the overall length of the two side portions 29, 31. Toward the side members 20, 22, the remaining region of the side portions 29, 31 is configured to be the second surface area 46. Both surface areas 44, 46 are separated by a line 48. This line 48 is the result of the processing. It is a theoretical line. It constitutes the boundary between the first surface area 44 and the second surface area 46. The second surface area 46 merges into the first surface area 44 without forming a step. The line 48 encircles a respective one of the side portions 29, 31 and is defined as a cross section transverse to the longitudinal direction of the shackle 24 and perpendicular to the plane of the paper in the FIGS. 1 and 2 of a respective one of the side portions 29, 31.

The first surface area 44 has a mat surface structure. It is obtained by blasting it with a blast material, this process being generally also referred to as sandblasting. The blast material used is a granular material with a grain size ranging from 20 micrometers to 2.4 mm, preferably from 40 micrometers to 1.2 mm. Grains of sand, of corundum, glass cullet, glass beads, glass balls, stainless steel balls, steel gravel and steel balls may be used as the blasting means. This enumeration is not exhaustive. The second surface area 46 is high gloss polished, it has a surface roughness of less than 5, preferably of less than 2 micrometers. The surface is mirror polished. Alloys having a high copper content, more specifically 80 to 90 percent by weight of copper, and sufficient mechanical strength as well as stainless steel may be used as the material for the side portions 29, 31 as well as the central portion 30.

The central portion 30 in FIG. 1 is completely formed with a first surface area 44. Its entire surface is processed by sandblasting just like the adjacent first surface regions 44 of the two side portions 29, 31. A generally symmetrical configuration is respectively achieved. The plane of symmetry lies in the center of the shackle 24 and at right angles to the plane of the paper in the FIGS. 1 and 2.

The method by means of which the different surface areas 44, 46 of the side portions 29, 31 are formed is described referring to FIG. 3. A cover member 50, also illustrated in FIG. 4, forms a grip around a respective side portion 29, 31. The line 48 that will be visible at a later stage is located at the limit at which the grip of the cover member 50 around a respective one of the side portion 29, 31 and toward the center of the shackle 24 ends. In FIG. 3, the distance between the side wall of the cover member 50 pointing toward the center of the shackle 24 and the ends of the cover members 29, 31 located in the center of the shackle is approximately 50% of the overall length of the side portions 29, 31.

As shown in FIG. 4, the cover member 50 has two halves 51, 52 that are built according to the same principle. Either half has an approximately semicircular cutout 54. Once the two halves 51, 52 are assembled as shown in FIG. 3, these cutouts 54 form a sealing grip all around a respective one of the side portions 29 and 31. FIG. 4 is a cross sectional view of a side portion 31 that is being surrounded by the two halves 51, 52 as they are being assembled.

The contact between the closed cover member 50 and a respective one of the side portions 29, 31 may be such that the side portions 29, 31 are simultaneously mechanically held or clamped. By means of a device that has not been illustrated but that is actually known, the entire unit made from the two cover members 50 and the side portions 29, 31 (as well as from the side members 20, 22 that are not shown) is rotated in the direction of the arrow 56 about an axis that lies in the plane of the paper of FIG. 3 and in the longitudinal direction of the shackle 24. During rotation, blast means 60 are applied to the side portions 29, 31 through a nozzle 58. In the configuration shown in FIG. 1, the blast means 60 also impinge onto the central portion 30. Said blast means 60 only reach the areas between the two cover members 50. The first surface areas 44 are configured in this way.

Prior to blasting, the side portions 29, 31 are high gloss polished in a manner corresponding to prior art production. In the prior art bits as they are sold by the applicant for example, the side portions 29, 31 are brought on the market in the corresponding high gloss polish. Measurement with a surface testing machine Mitutoyo Surftest 201 yields an Rz value for the average surface roughness of less than 1.5, preferably of between 0.5 and 1. All the surfaces located between the cover members 50 are processed with the blast means 60 and are roughened so as to exhibit a mat sheen rather than a glossy surface. The blasted second surface area has a significantly higher surface roughness Rz, e.g., Rz being equal to 8 and more.

FIG. 5 shows two halves 51, 52 of another embodiment of a cover member 50. In its assembled state, it substantially has the shape of a cylinder. Thanks to the additional, semi-cylindrical walls, the areas of the side portions 29, 31 forming the second surface area 46 are better covered than in the implementation shown in the FIGS. 3 and 4. As a result, the high gloss polished surface of the second surface area 46 is better preserved. Blast means reflected from the walls of the blast cabin are not allowed to reach this surface area either.

Blasting with blast means 60 may be carried out either automatically or manually. It is also possible to use a plurality of blast nozzles 48. It is advantageous to use special sealing members (not shown) that are provided on the cutout 54 of the halves 51, 52 and allow for accurate sealing. Semi-circular rubber members with lips resting on the side portions 29 or 31 are for example contemplated here. They can be replaced when destroyed by the blast means. Thanks to these seals, a precise, tight fit of the halves 51, 52 to the side portions 29, 31 can be provided.

It is also possible to give the line 48 a desired shape, for example a zigzag shape, a coiled shape and the like. The first surface region 44 has a mat surface. It is processed by blasting using a blast material.

For a better representation, in the embodiment according to the FIGS. 2 through 4, the free inner cross section of the hole of each eye is relatively large as compared to the cross section of the ring that constitutes the eye, so that the joints 26 also have large play in longitudinal direction of the side portions 29, 31 for example. The representation is thus easier to understand. In practical implementation however, the clearances are smaller. The cross section of the ring fills at least half of the hole of the eye, preferably more, as can be seen from FIG. 1. In a preferred embodiment, the ring cross section is larger than 70% of the free cross section of the eye's hole, 80% are also possible, and 90% as well.

In the embodiment according to FIG. 1, the central portion 30 has two paralleled joint bores 38, 40. In another embodiment, these joint bores may also be relatively right-angled. In the representation according to FIG. 1, these two bores are spaced a relatively short distance, for example between 2 and 3 cm, apart. As a result thereof, the overall central portion 30 is quite short, it is a maximum of 4 cm in length and preferably a maximum of 3 cm in length. It is markedly thicker than the adjacent region of the side portions so that the already mentioned larger cross section in the center of the shackle 24 is obtained. In both exemplary embodiments, the cross section of the shackle 24 diminishes symmetrically to both sides and thickens again in the region of the bore 32 to attain a thickness which is comparable to the thickness in the center.

In FIG. 1, the central portion 30 is configured in the shape of an olive. It may also have another design and for example be a disk with two eyes axially protruding on the sides thereof, a roll, of a rather spherical shape, and so on.

Advantageously, the central portion 30 has two bores 38, 40 the center lines of which are spaced less than 2.5 cm, preferably less than 2 cm, apart.

Preferably, the at least one joint 26, 28 and all the other joints 26, 28 are configured to be eyes interlocking with a clearance at the end regions of the side portions or of the central portions 30 respectively.

The invention claimed is:

1. A snaffle bit for a horse comprising: two side members and one shackle interposed between the side members, the shackle including at least one joint and two side portions, each side portion having one end that is remote from the joint, and one bore being formed in the remote end of each of the side portions for receiving a respective one of the side members so as to allow the side members to move freely, wherein each side portion comprises a first surface area and a second surface area, the first surface area extends, commencing at the joint, as far as at least 20% and not exceeding 50% of the overall length of the side portion, the second surface area adjoins the first surface area and extends as far as the remote end of the side portion, the first surface area has a mat surface, and the second surface area has a high gloss surface.

2. The snaffle bit as set forth in claim 1, wherein the first surface area and the second surface area only differ in the texture of the surface.

3. The snaffle bit as set forth in claim 2, wherein the central portion has a maximum length of 4 cm.

4. The snaffle bit as set forth in claim 1, wherein the first surface area and the second surface area merge into each other without forming a step.

5. The snaffle bit as set forth in claim 1, wherein the first surface area and the second surface area are adjacent along a line and the line is a regular line.

6. The snaffle bit as set forth in claim 5, wherein the line encircles the side portion.

7. The snaffle bit as set forth in claim 6, wherein the central portion has a maximum length of 4 cm.

8. The snaffle bit as set forth in claim 7, wherein the paralleled joint bores are spaced less than 2.5 cm apart.

9. The snaffle bit as set forth in claim 7, wherein the central portion is made from one piece.

10. The snaffle bit as set forth in claim 1, wherein each side portion is made from one piece.

11. The snaffle bit as set forth in claim 1, wherein the first surface area is produced by a blasting treatment using a blast means, the blast means having a grain size of at least 20 micrometers and not exceeding 2.4 millimeters.

12. The method for manufacturing a snaffle bit for a horse as set forth in claim 11, wherein the grain size ranges between 40 micrometers and 1.2 millimeters.

13. The snaffle bit as set forth in claim 1, wherein the second surface area is high gloss polished.

14. A method of manufacturing a snaffle bit for a horse, wherein the manufactured snaffle bit comprises two side members and one shackle interposed between the side members, the shackle including at least one joint and two side portions, each side portion having one end that is remote from the joint, and one bore being formed in the remote end of each of the side portions for receiving a respective one of the side members so as to allow the side members to move freely, wherein each side portion comprises a first surface area and a second surface area, the first surface area extends, commencing at the joint, as far as at least 20% and not exceeding 50% of the overall length of the side portion, the second surface area adjoins the first surface area and extends as far as the remote end of the side portion, the first surface area has a mat surface, and the second surface area has a high gloss surface; the method comprising:

providing a side portion having a high gloss polished surface covered by a cover member in such a manner that, commencing at the remote end of the side portion, a covered portion comprising at least 50% and at the most 80% of the overall length of the side portion is covered, the rest remains free, and blasting the rest with a blast means having a grain size of at least 20 micrometers and not exceeding 2.4 millimeters.

15. The method for manufacturing a snaffle bit for a horse as set forth in claim 14, wherein the side portion of the snaffle bit is rotated during blasting.

16. The method for manufacturing a snaffle bit for a horse as set forth in claim 14, wherein the covered portion touches the side portion along a line.

17. The method for manufacturing a snaffle bit for a horse as set forth in claim 14, wherein the grain size ranges between 40 micrometers and 1.2 millimeters.

18. A method of manufacturing a snaffle bit for a horse, wherein the manufactured snaffle bit comprises two side members and one shackle interposed between the side members, the shackle including at least one joint and two side portions, each side portion having one end that is remote from the joint, and one bore being formed in the remote end of each of the side portions for receiving a respective one of the side members so as to allow the side members to move freely, wherein each side portion comprises a first surface area and a second surface area, the first surface area extends, commencing at the joint, as far as at least 20% and not exceeding 50% of the overall length of the side portion, the second surface area adjoins the first surface area and extends as far as the remote end of the side portion, the first surface area has a mat surface, and the second surface area has a high gloss surface; the method comprising:

providing an unfinished snaffle bit having one of (a) two side portions and (b) two side portions and a central portion, the two side portions having a high gloss polished surface covered with cover members in such a manner that, commencing at the remote end of each side portion, a covered portion comprising at least 50% and at the most 80% of the overall length of each side portion is covered and the rest located between the cover members remains free, and blasting the rest with a blast means having a grain size of at least 20 micrometers and not exceeding 2.4 millimeters.

19. The method for manufacturing a snaffle bit for a horse as set forth in claim 18, wherein the covered portion touches the side portion along a line.

20. The method for manufacturing a snaffle bit for a horse as set forth in claim 18, wherein the grain size ranges between 40 micrometers and 1.2 millimeters.

* * * * *